US005507259A

United States Patent [19]

Tanaka

[11] Patent Number: 5,507,259

[45] Date of Patent: Apr. 16, 1996

[54] STRUCTURE OF CYLINDER HEAD ASSEMBLY

[75] Inventor: Ryuji Tanaka, Shizuoka, Japan

[73] Assignee: Suzuki Motor Corporation, Hamamatsu, Japan

[21] Appl. No.: 230,085

[22] Filed: Apr. 20, 1994

[30] Foreign Application Priority Data

Sep. 30, 1993 [JP] Japan ..... 5-268003

[51] Int. Cl.[6] ..... F01M 11/02

[52] U.S. Cl. ..... 123/196 M; 123/193.5; 123/90.34; 123/90.38

[58] Field of Search ..... 123/196 R, 196 M, 123/193.5, 90.33, 90.34, 90.38

[56] References Cited

U.S. PATENT DOCUMENTS 5,143,004 9/1992 Hirose ..... 123/90.34

FOREIGN PATENT DOCUMENTS 1-253552 10/1989 Japan .

*Primary Examiner*—Henry C. Yuen
*Assistant Examiner*—Erick Solis
*Attorney, Agent, or Firm*—Flynn, Thiel, Boutell & Tanis

[57] ABSTRACT

A cylinder head assembly having a camshaft axially supported by a cylinder head through a camshaft housing having a head oil passageway for guiding lubricating oil to those parts of the cylinder head which require lubrication. The camshaft housing is provided with an oil reserve chamber communicating with the oil head passageway. One end of a through-passageway communicates with an upper part of the oil reserve chamber, and the other end of this through-passageway communicates with a camshaft journal of the camshaft housing.

12 Claims, 11 Drawing Sheets

STRUCTURE OF CYLINDER HEAD ASSEMBLY

FIELD OF THE INVENTION

This invention relates to the structure of a cylinder head assembly, and more particularly to the structure of a cylinder head assembly in which air generated in an oil passageway is prevented from being supplied to those parts which require lubrication, and in which a lubrication oil is effectively utilized, machining efficiency is good, the number of parts is prevented from being increased, and a camshaft housing is improved in rigidity.

BACKGROUND OF THE INVENTION

In an engine, lubrication is applied to those parts of a cylinder block and a cylinder head, which require lubrication, in order to maintain the functions of such parts. Specifically, as shown in FIG. 13, an engine 102 comprises a cylinder block 104, a crank lower case 106, an oil pan 108, a cylinder head 110, and a cylinder head cover (not shown) for defining a cam chamber when placed on the cylinder head 110. Between the cylinder block 104 and the crank lower case 106, a crankshaft 112 is axially supported. On an upper part of the cylinder head 110, an inlet side and an outlet side are coacted with a camshaft housing (not shown) having an integral structure therewith, and a first-side camshaft 114 located on one side, as well as a second-side camshaft (not shown) located on the other side, is axially supported. The rotations of the first-side camshaft 114 and the second-side camshaft (not shown) actuate a first-side hydraulic adjuster (HLA) 116 located on one side of the cylinder head 110 and a second-side hydraulic adjuster (not shown) located on the other side to cause an inlet valve 118 and an outlet valve (not shown) to move reciprocally. The first-side hydraulic adjuster 116 is provided with a high pressure chamber 116*a*.

In order to feed lubrication oil to the engine 102, an oil pump 120 is mounted on the crank lower case 106. The oil pump 120 draws the lubrication oil in the oil pan 108 from an inlet tube 124 though a strainer 122, and feeds it, under pressure, to those parts which require lubrication, such as the first-side hydraulic adjuster 116, the second-side hydraulic adjuster, a cam journal (not shown) of the camshaft housing via first and second block side oil passageways 126 and 128 which are formed in the cylinder block 104 and first and second head side oil passageways 130 and 132 which are formed in the cylinder head 110. By this, lubrication is applied to various parts of the engine 102.

A structure of a cylinder head of this type is disclosed, for example, in Japanese Laid-Open Patent Application No. Hei 1-253552. As shown in FIG. 14, the structure described in this official publication has an oil feed passageway 204 formed in a generally central part of a cylinder head 202 of an engine, the oil feed passageway 204 being in communication with a reserve chamber 206 formed in an upper part of the cylinder head 202, the reserve chamber 206 being, in turn, communicated with an adjuster oil passageway 210 which is in communication with an adjuster guide portion 208 and a second-side adjuster oil passageway 214 which is in communication with a second-side adjuster guide portion 212. A plug 216 for sealing the reserve chamber 206 is formed with an air removing hole 218 for discharging air (air bubble) generated in the oil passageways.

Incidentally, in the structure of a cylinder head according to the prior art, if air (air bubble) is contained in the lubrication oil in the oil passageways, which is fed under pressure by an oil pump, the lubrication oil is supplied to those parts which require lubrication such as a hydraulic adjuster, etc., together with this air. In this way, when the air-containing lubrication oil is supplied, for example, to the hydraulic adjuster, the air enters the high pressure chamber of the hydraulic adjuster to create a sponge-like condition. As a result, a foreign sound is generated in the engine due to poor operation of the hydraulic adjuster. When the engine is operated for a long time or at a high speed in such a condition as just mentioned, the hydraulic adjuster, the inlet valve, etc. are damaged.

Therefore, in order to obviate the above inconveniences, according to the present invention there is firstly provided a structure of a cylinder head assembly having a camshaft axially supported by a cylinder head through a camshaft housing and a head oil passageway for guiding a lubrication oil to those parts of the cylinder head which require lubrication, the structure of the cylinder head assembly being characterized in that the camshaft housing is provided with an oil reserve chamber communicating with the head oil passageway.

Secondly, there is provided a structure of a cylinder head assembly having a camshaft axially supported by a cylinder head through a camshaft housing and a head oil passageway for guiding a lubrication oil to those parts of the cylinder head which require lubrication, the structure of the cylinder head assembly being characterized in that the camshaft housing is provided with an oil reserve chamber communicating with the head oil passageway, one end of a through-passageway being communicated with an upper part of the oil reserve chamber and the other end thereof being communicated with a camshaft journal of the camshaft housing.

According to the construction of the present invention, firstly, since the oil reserve chamber is formed in the camshaft housing, the number of parts can be avoided from increasing, the camshaft housing can be improved in rigidity, and machinability can be improved.

Secondly, the air, which remains in an upper part of the oil reserve chamber due to stopping of the engine, is supplied to the camshaft journal side via the through-passageway when the engine is driven. As a result, the air is not supplied to such parts as the hydraulic adjuster, etc., and therefore the functions of the parts such as the hydraulic adjuster, etc. are maintained in a favorable condition to ensure a favorable operation of the engine. Furthermore, since the through-passageway acts as means for removing the air in the oil reserve chamber and feeding the lubrication to the camshaft journal, the lubrication oil can be effectively utilized.

DETAILED DESCRIPTION

Figure 1:
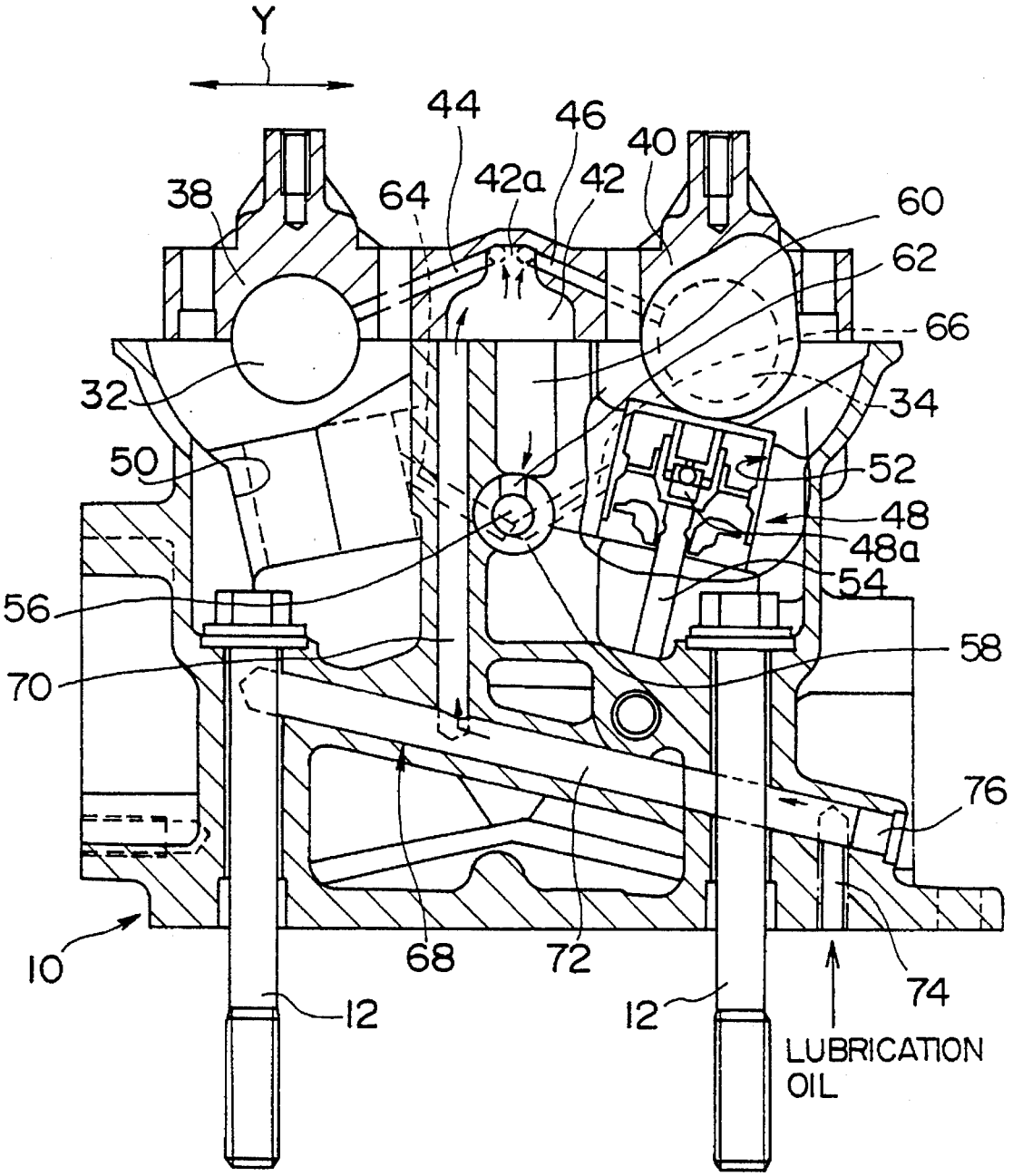
FIG. 1 is an enlarged cross-sectional view taken on line 1—1 of FIG. 3.
Figure 2:
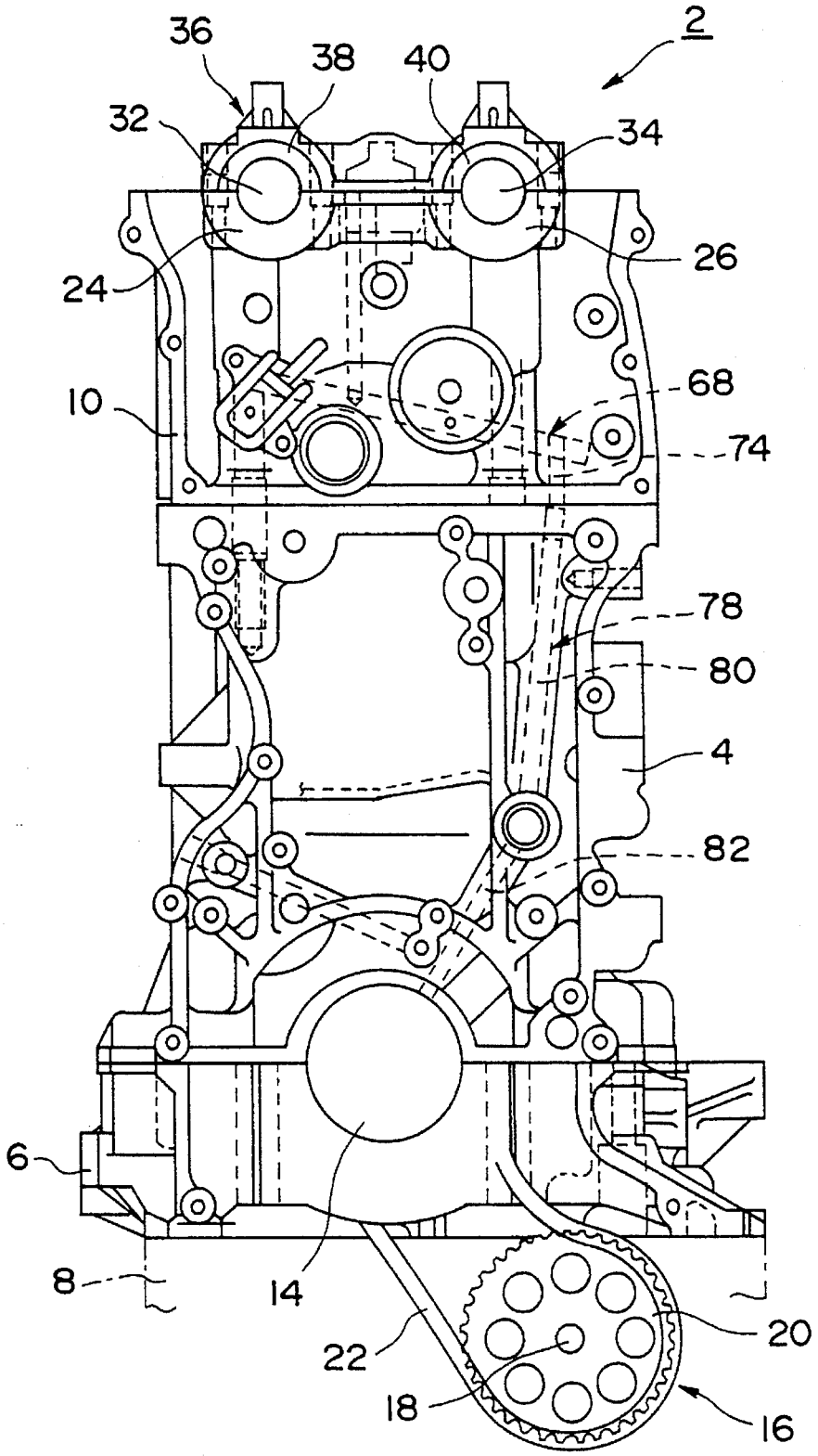
FIG. 2 is a schematic end elevational view of a construction of an engine.
Figure 3:
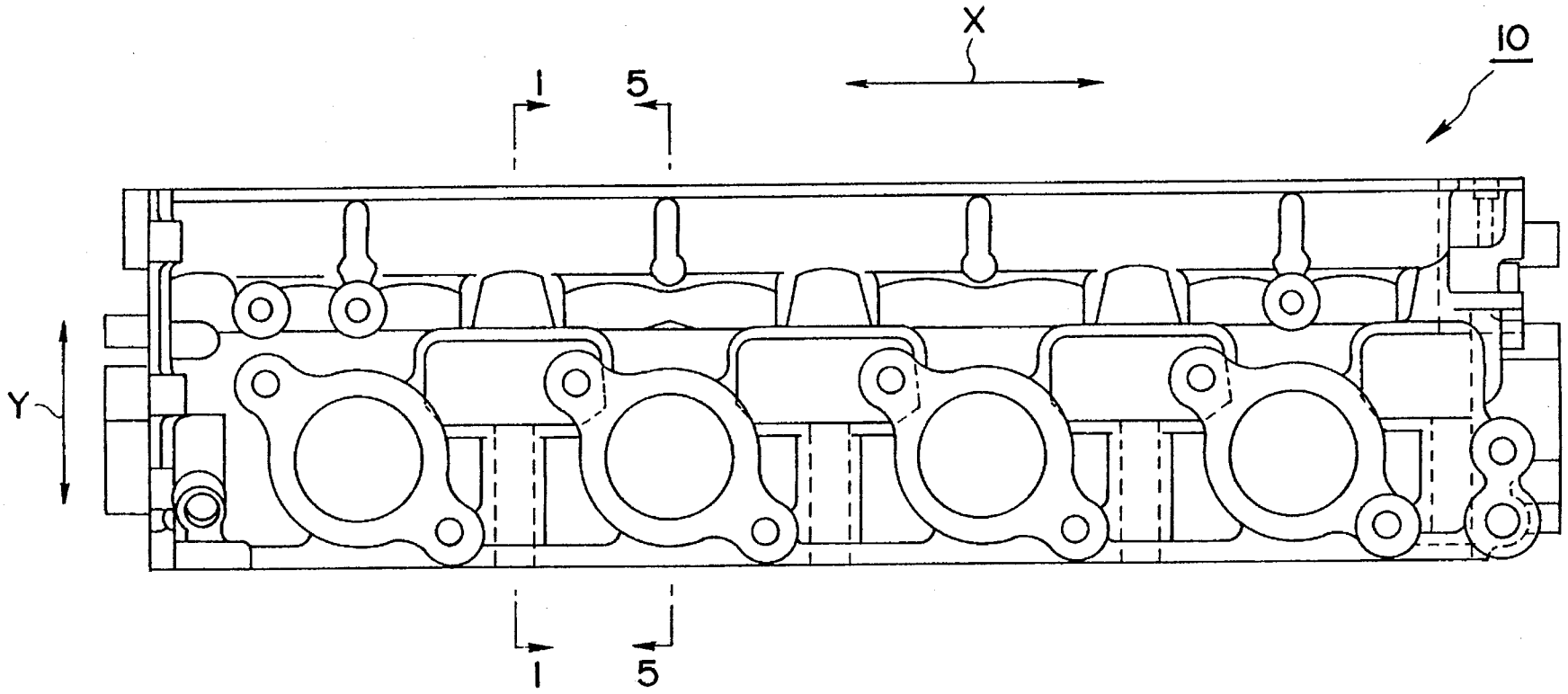
FIG. 3 is a side view of a cylinder head.

FIGS. 1 through 12 show one embodiment of the present invention. In FIG. 2, reference numeral 2 denotes an engine; 4 a cylinder block; 6 a crank lower case; 8 an oil pan; and 10 a cylinder head. As shown in FIG. 1, the cylinder head 10 is tightly secured to the cylinder block 4 by head tightening bolts 12. Between the cylinder block 4 and the crank lower case 6, a crankshaft 14 is axially supported. A cylinder head cover (not shown) is placed on the cylinder head 10.

The crank lower case 6 is provided with an oil pump 16. This oil pump 16 has a pump shaft 18 and a pump sprocket 20 mounted on the pump shaft 18. The pump sprocket 20 is engaged with a pump driving chain 22, which drives a pump driving sprocket (not shown) which is mounted on the crankshaft 14.

Figure 4:
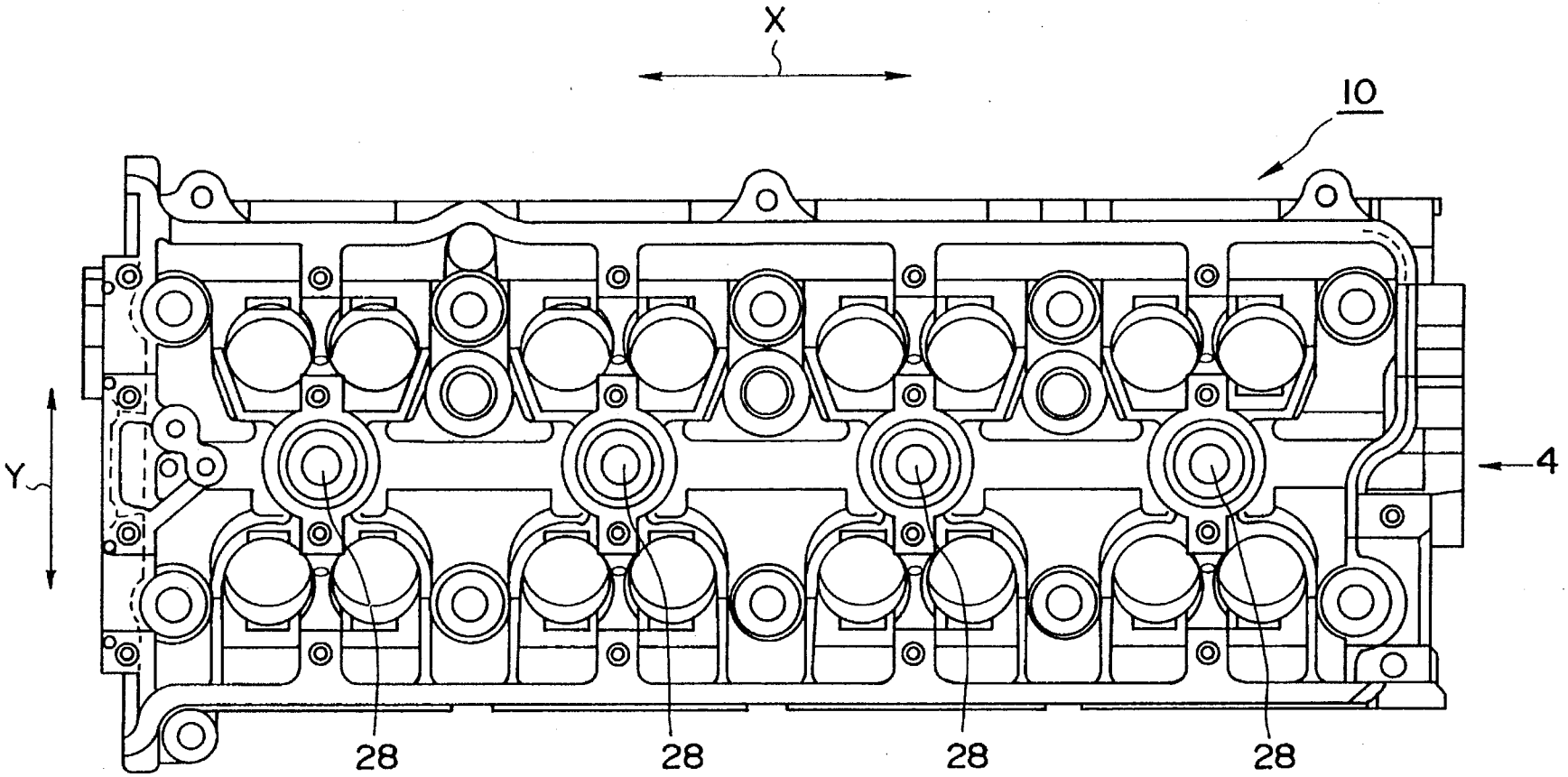
FIG. 4 is a plan view of a cylinder head.

As shown in FIGS. 2–6, first-side and second-side camshaft bearing portions 24 and 26, which are directed in a longitudinal direction X (FIGS. 3 and 4) and spaced apart a predetermined distance from each other in a width direction Y, are formed on an upper part of the cylinder head 10. Between the first-side and second-side camshaft bearing portions 24 and 26, a plurality of spark plug holes 28 are formed in such a manner as to be spaced apart a predetermined distance in the longitudinal direction X as shown in FIG. 4.

Figure 5:
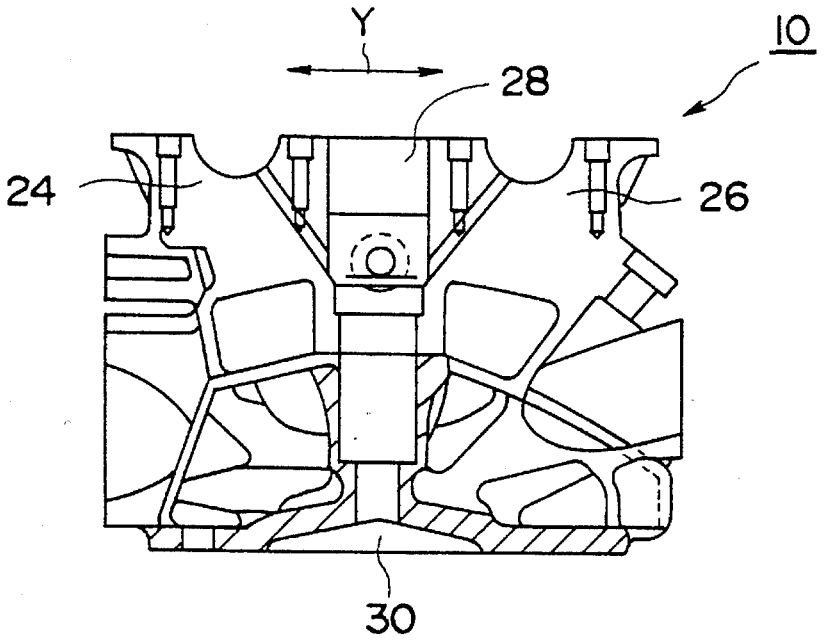
FIG. 5 is a cross-sectional view taken on line 5—5 of FIG. 3.
Figure 6:
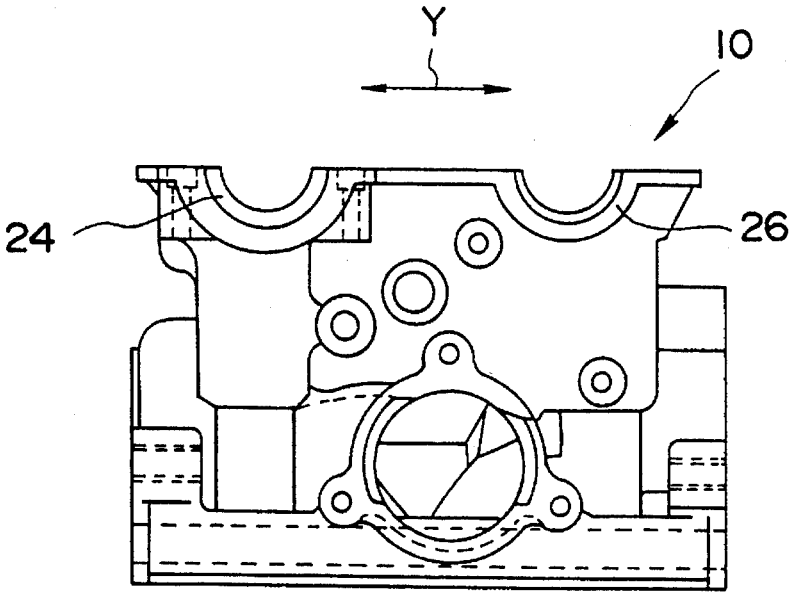
FIG. 6 is a right end view of the cylinder head when viewed in a direction as indicated by an arrow 4 of FIG. 4.
Figure 7:
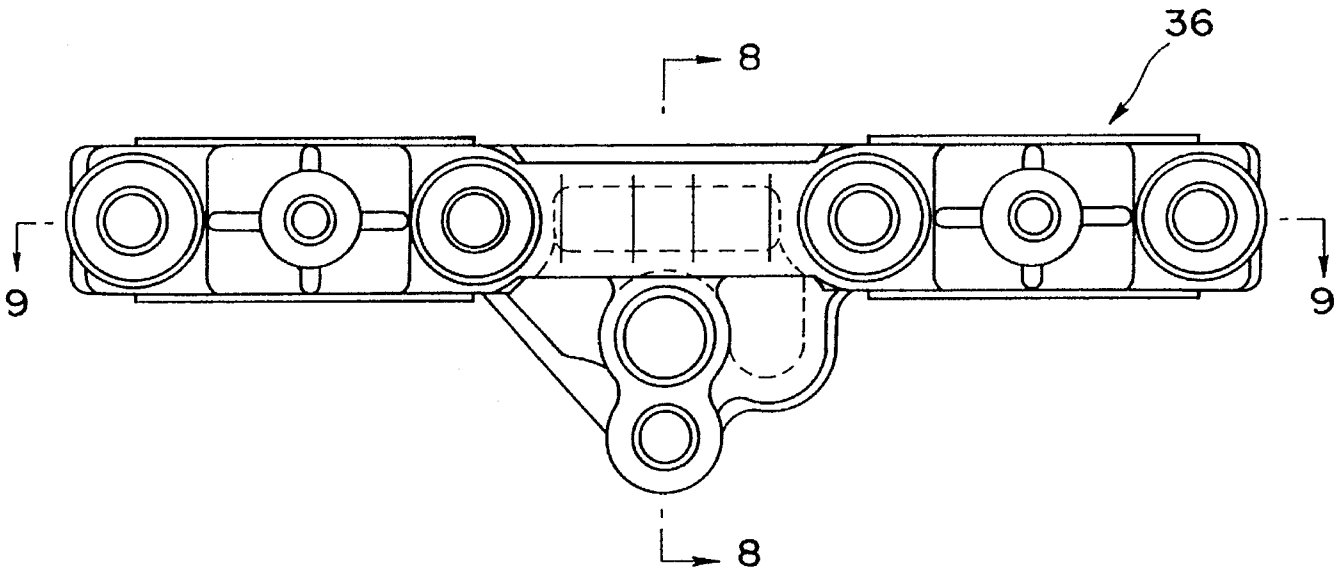
FIG. 7 is a plan view of a camshaft housing.
Figure 8:
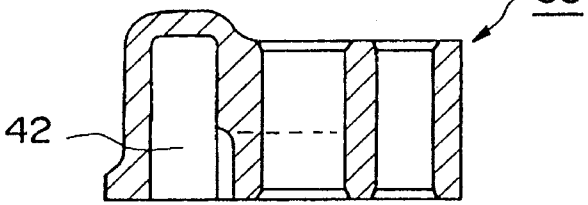
FIG. 8 is a cross-sectional view taken on line 8—8 of FIG. 7.

As shown in FIG. 5, a plurality of chambers 30 are formed in a lower part of the cylinder head 10 in such a manner as to correspond to the respective spark plug holes 28.

First-side and second-side camshafts 32 and 34 are placed respectively on the first-side and second-side camshaft bearing portions 24 and 26. These camshafts 32 and 34 are axially supported by a camshaft housing 36 from above.

As shown in FIGS. 1 and 2, the camshaft housing 36 is formed with first-side and second-side camshaft journals 38 and 40 adapted to axially support the first-side and second-side camshafts 32 and 34, respectively, and an inlet side and an outlet side are of an integral structure.

Figure 9:
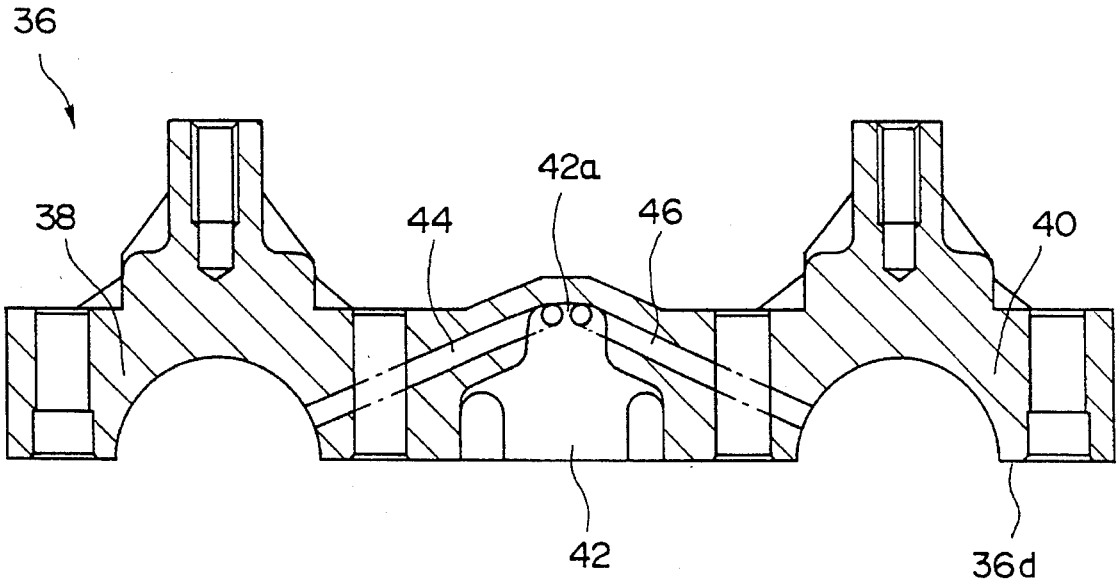
FIG. 9 is a cross-sectional view taken on line 9—9 of FIG. 7.
Figure 10:
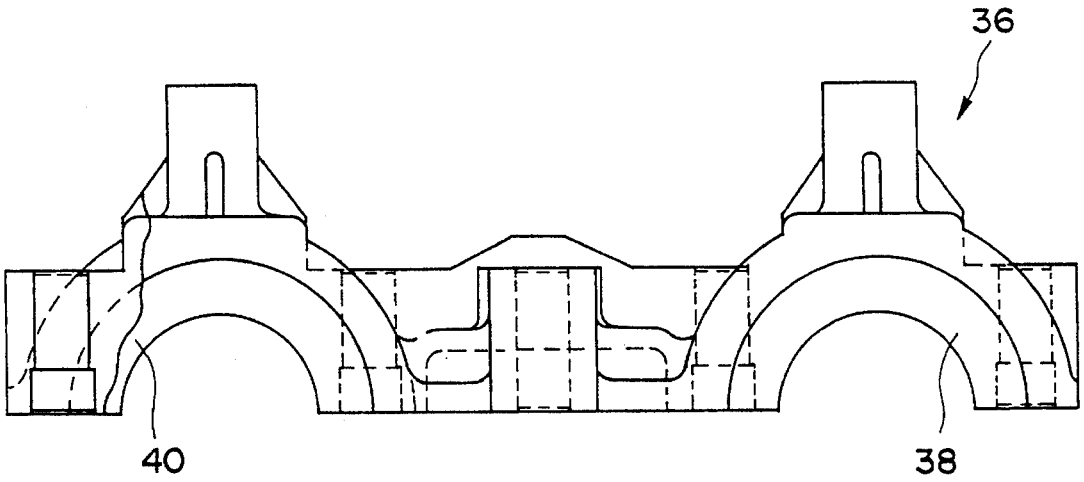
FIG. 10 is a right side view of the camshaft housing of FIG. 7.
Figure 11:
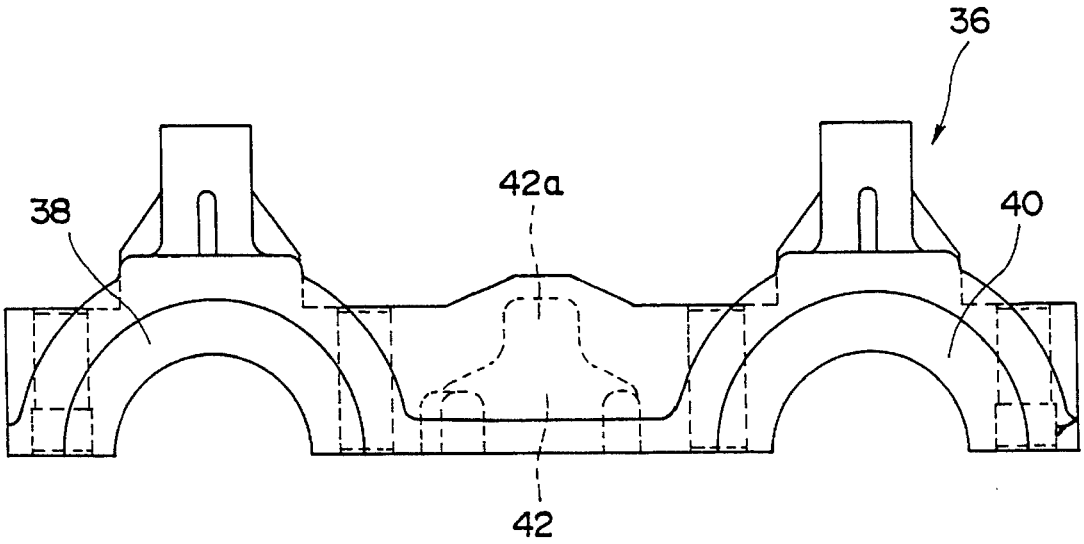
FIG. 11 is a bottom view of the camshaft housing of FIG. 7.
Figure 12:
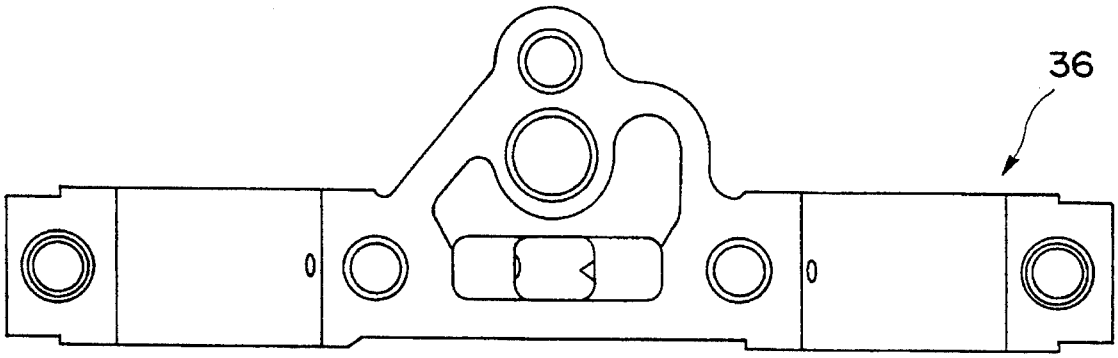
FIG. 12 is a left side view of the camshaft housing of FIG. 11.
Figure 13:
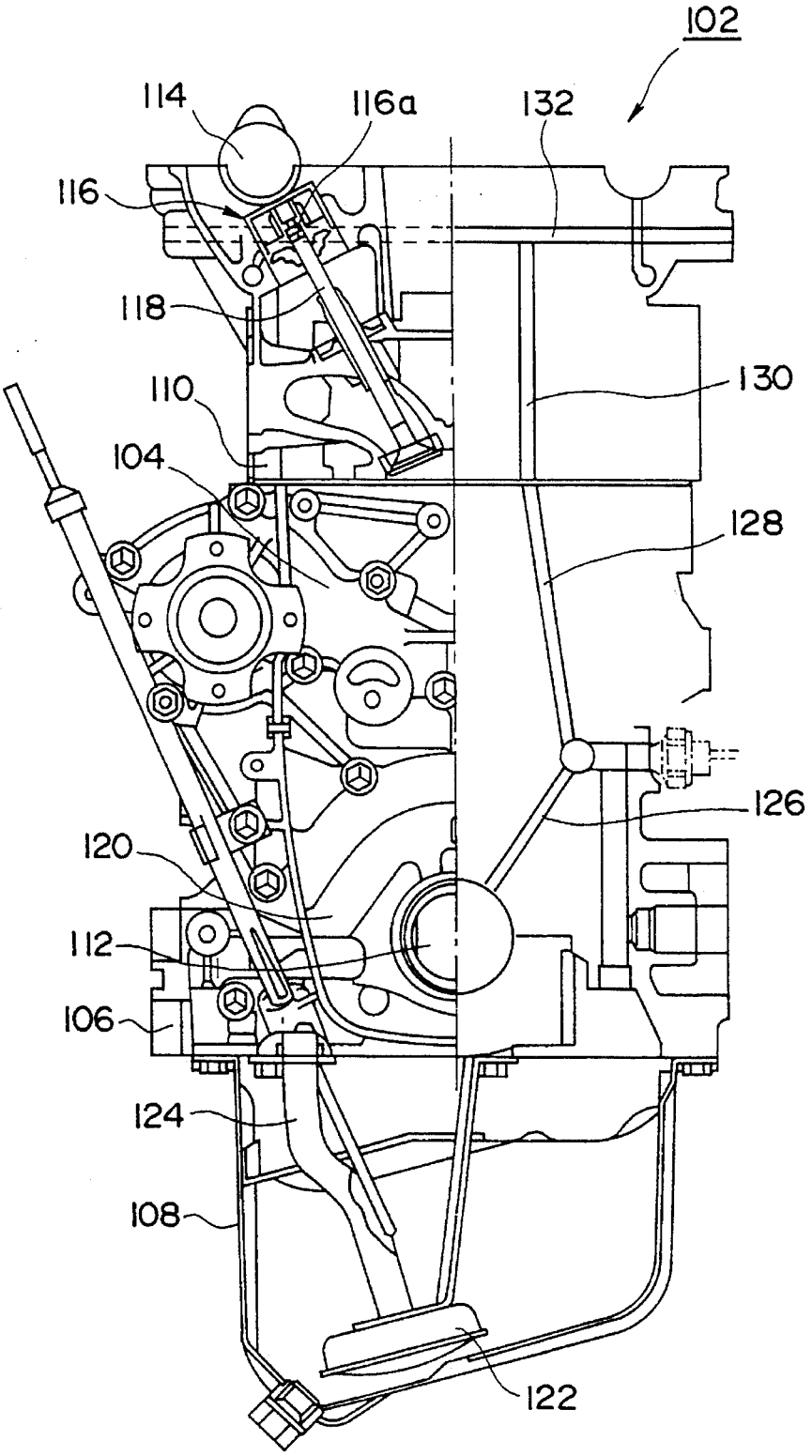
FIG. 13 PRIOR ART
FIG. 13 is a schematic view of a construction of an engine according to the prior art.
Figure 14:
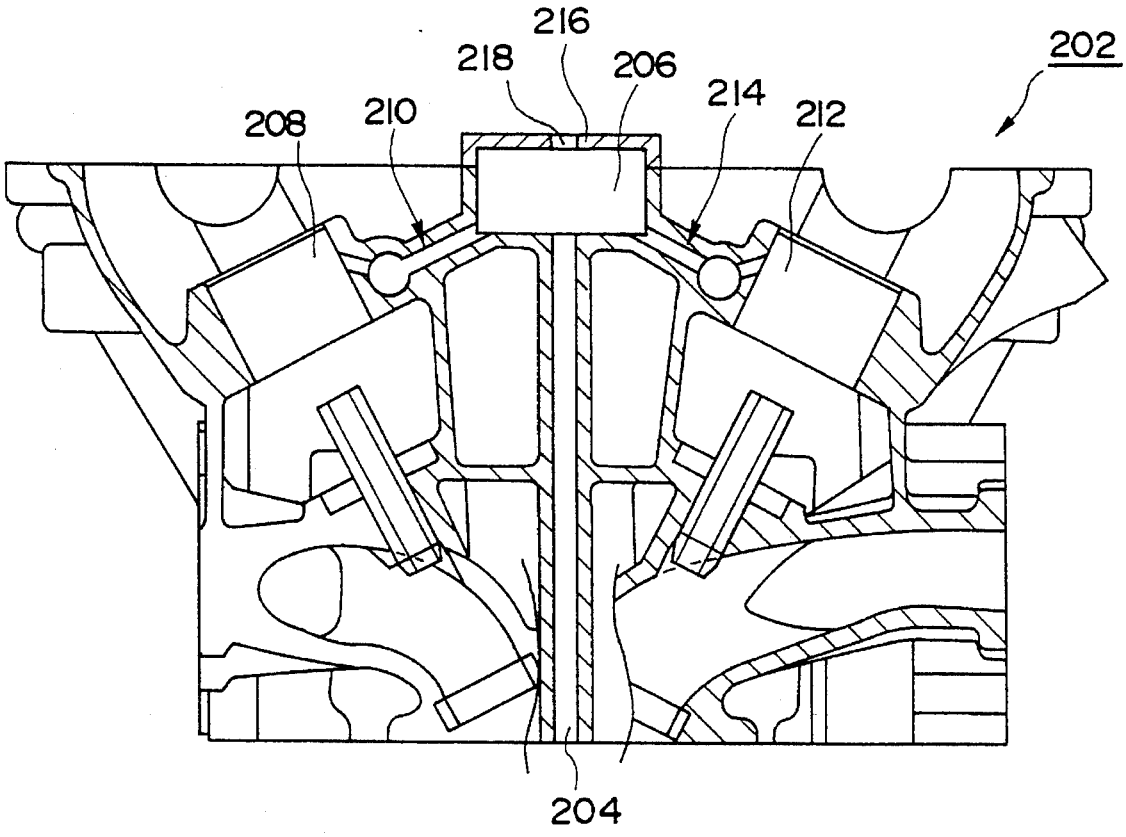
FIG. 14 PRIOR ART
FIG. 14 is a cross-sectional view of a cylinder block according to the prior art.

As shown in FIGS. 9 and 10, the camshaft housing 36 is further formed with an oil reserve chamber 42 generally at a central part thereof which is open to a housing bottom face 36*d*. As seen, this oil reserve chamber 42 is of the type which is not open to the camshaft chambers.

As shown in FIG. 9, the camshaft housing 36 is proved with one end of a first-side through-passageway 44 which is in communication with an upper part 42*a* of the oil reserve chamber 42. The other end of the first-side through-passageway 44 is formed obliquely below in such a manner as to be directed toward the first-side camshaft journal 38. The first-side through-passageway 44 is formed by drilling or the like from the first-side camshaft journal 38 side. The camshaft housing 36 is provided with one end of a second-side through-passageway 46 which is in communication with the other side of the upper part 42*a* of the oil reserve chamber 42. The other end of the second-side through-passageway 46 is formed obliquely below in such a manner as to be directed toward the second-side camshaft journal 40. This second-side through-passageway 46 is formed by drilling or the like from the second-side camshaft journal 40 side.

The cylinder head 10 as shown in FIG. 1 is formed with a first-side hydraulic adjuster (HLA) (not shown), one side of a second-side hydraulic adjuster (HLA) 48 and adjuster guide portions 50 and 52 in such a manner as to correspond to the first-side and second-side camshaft bearing portions 24 and 26, respectively. The hydraulic adjusters 48 such as are operated to convert the rotational motions of the first-side and second-side camshafts 32 and 34 to linear motions to respectively activate an inlet valve (not shown) and an outlet valve 54. A high pressure chamber 48*a* is formed within the hydraulic adjuster 48.

As shown in FIG. 1, the cylinder head 10 is provided with an oil tube 58 which extends longitudinally and forms a head main oil passageway 56. In order to communicate this head main oil passageway 56 with the oil reserve chamber 42, an upper part of the cylinder head 10 is formed with a head oil chamber 60 which is in direct communication with the oil reserve chamber 42. Formed in the oil tube 58 is a tube penetration hole 62 which is in communication with a lower part of the head oil chamber 60 and also with the head main oil passageway 56.

First-side and second-side adjuster oil passageways 64 and 66 are at one end in communication with the first-side and second-side adjuster guide portions 50 and 52 respectively, and at the other end are in communication with the head main oil passageway 56.

The cylinder head 10 is formed with a head oil passageway system 68 (FIG. 1) to guide the lubrication oil from the oil pump 16 to the oil reserve chamber 42 formed in the camshaft housing 36. The head oil passageway system 68 comprises an upper head oil passageway 70 communicating with the oil reserve chamber 42 and directed downwardly therefrom, an intermediate head oil passageway 72 communicating with the lower end of upper head oil passageway 70, the passageway 72 being directed in the width direction Y and formed obliquely below the passageway 70, and a lower head oil passageway 74 communicating with the intermediate head oil passageway 72 and directed downwardly. The upper head oil passageway 70 is formed by drilling or the like from above the cylinder head 10. The intermediate head oil passageway 72 is formed by drilling or the like from one lower side in the width direction Y.

As shown in FIG. 2, the cylinder block 4 is formed with a block oil passageway system 78 which is in communication with passageway 74 of the head oil passageway system 68. The block oil passageway system 78 comprises an upper block oil passageway 80 which is in communication with the lower side head oil passageway 74 and a lower block oil passageway 82 communicating with the upper block oil passageway 80 and directed toward the crankshaft 14 side.

Owing to the above arrangement, the lubrication oil from the oil pump 16 is supplied to the oil reserve chamber 42 via the block oil passageway system 78 and head oil passageway system 68, and fed, under pressure, to the head main oil passageway 56, etc.

Next, the operation of the above embodiment will be described.

When the oil pump 16 is driven, the lubrication oil is fed to the oil reserve chamber 42 in the camshaft housing 36 via the block oil passageway system 78 and head oil passageway system 68.

In a normal time, the lubrication oil is fed from the oil reserve chamber 42 to the first-side and second-side camshaft journals 38 and 40 via the first-side and second-side through-passageways 44 and 46 to apply lubrication to the first-side and second-side camshaft journals 38 and 40.

In case air such as an air bubble enters the lubrication oil in the oil passageways such as the block oil passageway system 78 and head oil passageway system 68, etc., if the engine 2 is maintained in its stopping condition, the air stays in the upper part of the oil reserve chamber 42.

When the engine 2 is driven, the air at the upper part 42*a* of the oil reserve chamber 42 is supplied from the first-side and second-side through-passageways 44 and 46 to the first-side and second-side camshafts 38 and 40 together with the lubrication oil, and therefore, never flows toward the head main oil passageway 56 side.

As a result, since the air-contained lubrication oil is not supplied to the first-side and second-side adjuster guide portions 50 and 52, air does not enter the high pressure chambers 48*a* in the hydraulic adjusters 48. Accordingly, a favorable operation of the hydraulic adjusters 48 is available, the engine 2 is prevented from becoming abnormal, and the hydraulic adjusters 48, and the inlet valves and the outlet valves 54 are not broken even in the engine 2 is operated for a long time or at a high speed.

Since the first-side and second-side through-passageways 44 and 46 can be used both as air-removing passageways and lubrication oil passageways, the lubrication oil can be effectively utilized.

In case the through-passageways 44 and 46 are formed only for the purpose of removing air, it is usually necessary to set the diameter of these passageways small in order to avoid the lowering of hydraulic pressure. In this embodiment, machining efficiency of the camshaft housing 36 is favorable and a low cost is attainable.

Furthermore, since the oil reserve chamber 42 is formed generally in an intermediate part of the camshaft housing 36 with the inlet side and the outlet side being of an integral structure therewith, the number of parts can be avoided from increasing and the camshaft housing 36 can be improved in rigidity.

As apparent from the foregoing detailed description, according to the present invention, firstly owing to the arrangement in that the camshaft housing for axially supporting the camshaft is provided with the oil reserve chamber which is in communication with the head oil passageway, the number of parts can be avoided from increasing, the camshaft housing can be improved in rigidity, and machining efficiency can be improved.

Secondly, owing to the arrangement in that one end of the through-passageway is in communication with an upper part of the oil reserve chamber and the other end thereof is in communication with the camshaft journal of the camshaft housing, the air generated in the various oil passageways is not supplied to such parts as the hydraulic adjuster, etc., and the functions of the parts such as the hydraulic adjuster, etc. can be maintained in a favorable condition to ensure a favorable operation of the engine. Furthermore, since the through-passageway acts as a means for removing the air in the oil reserve chamber and feeding the lubrication oil to the cam journal, the lubrication oil can be effectively utilized.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A cylinder head assembly comprising:

a cylinder head including a first portion of at least one camshaft journal for rotatably supporting a first camshaft, and a head oil passageway for guiding oil within said cylinder head; and a camshaft housing mounted to said cylinder head and having a second portion of said camshaft journal disposed therein so as to cooperate with said first portion disposed in said cylinder head and rotatably retain a first camshaft therebetween, said camshaft housing including an oil reserve chamber disposed centrally therein in communication with a source of lubrication oil, said oil reserve chamber having a lower chamber portion, which includes an opening in communication with said head oil passageway for the passage of oil therebetween, and an upper chamber portion, said camshaft housing including a housing passageway having a first end in communication with said upper chamber portion and a second end in communication with said camshaft journal.

2. The cylinder head assembly according to claim 1, wherein said first end of said housing passageway communicates with said upper chamber portion of said oil reserve chamber at an upper end thereof and said second end communicates with said second portion of said camshaft journal.

3. The cylinder head assembly according to claim 2, wherein said housing passageway angles downwardly away from said first end toward said second end thereof.

4. The cylinder head assembly according to claim 3, which includes two of said camshaft journals for rotatably supporting said first camshaft and a second camshaft respectively, said camshaft journals being in a laterally spaced relation relative to the other on opposite sides of said oil reserve chamber, said cam housing including two of said housing passageways, each said housing passageway angling downwardly away from said oil reserve chamber to said first camshaft journal and said second camshaft journal respectively.

5. The cylinder head assembly according to claim 1, wherein said cylinder head includes at least one hydraulic adjuster guide chamber for receiving at least one corresponding hydraulic adjuster unit therein so as to be operatively engaged with a cam fixed on a camshaft, and an adjuster passageway having a first end opening into said head oil passageway in communication therewith and a second end in communication with said hydraulic adjuster guide chamber for supplying said oil thereto.

6. A cylinder head assembly comprising:

a cylinder head including first and second lower journal portions of respective first and second camshaft journals which are disposed in a laterally spaced relation and open upwardly from an upward facing head surface of said cylinder head for rotatably receiving and supporting respective first and second camshafts, and a head oil passageway, which extends longitudinally through said cylinder head for guiding oil therein, said cylinder head including at least first and second hydraulic adjuster guide chambers for slidably receiving corresponding hydraulic adjuster units therein so as to each be operatively engaged with a cam fixed respectively on each of said first and second camshafts, and first and second adjuster passageways each having a first end connected to said head oil passageway in communication therewith and a second end in communication with respective ones of said first and second hydraulic adjuster guide chambers; and a camshaft housing mounted to said upward facing head surface and including first and second upper journal portions of said first and second camshaft journals respectively, said upper journal portions opening downwardly and cooperating respectively with said lower journal portions so as to rotatably retain said camshafts respectively therein, said camshaft housing including an oil reserve chamber disposed centrally therein in communication with a source of lubrication oil, said oil reserve chamber having a lower chamber portion which includes an opening in communication with said head oil passageway for the passage of oil therebetween and an upper chamber portion, said camshaft housing including first and second housing passageways each having a first end in communication with said upper chamber portion and a second end in communication respectively with said upper journal portion of said camshaft journal for supplying said oil thereto.

7. The cylinder head assembly according to claim 6, wherein said first end of said housing passageway communicates with said upper portion of said oil reserve chamber at an upper end thereof.

8. The cylinder head assembly according to claim 7, wherein each said housing passageway angles downwardly away from said first end toward said second end thereof.

9. A cylinder head assembly in communication with a source of lubrication oil comprising:

at least one camshaft journal for rotatably supporting a first camshaft;

at least one hydraulic adjuster guide chamber for slidably receiving a hydraulic adjuster unit therein so as to be operatively engaged with a cam fixed on said first camshaft;

an oil supply passageway extending longitudinally through said cylinder head assembly for guiding oil within said cylinder head assembly;

an adjuster passageway having a first end opening into said oil supply passageway in communication therewith and a second end in communication with said hydraulic adjuster guide chamber;

an oil reserve chamber disposed centrally and above said oil supply passageway having a lower chamber portion which includes an opening in communication with said oil supply passageway for the passage of oil therebetween and an upper chamber portion which has an upper end; and a journal passageway having a first end in communication with said upper chamber portion proximate said upper end and a second end in communication with said camshaft journal.

10. The cylinder head assembly according to claim 9, wherein said journal passageway angles downwardly away from said first end toward said second end thereof.

11. The cylinder head assembly according to claim 10, which includes two of said camshaft journals for rotatably supporting said first camshaft and a second camshaft respectively, said camshaft journals being in a laterally spaced relation relative to the other on opposite sides of said oil reserve chamber, said cylinder head assembly including two of said journal passageways, each said journal passageway angling downwardly away from said oil reserve chamber to said first camshaft journal and said second camshaft journal respectively.

12. The cylinder head assembly according to claim 11, wherein said cylinder head assembly includes a cylinder head and a cam housing mounted to an upwardly facing head surface of said cylinder head, said oil reserve chamber being disposed within said cam housing and said oil supply passageway being disposed within said cylinder head.

* * * * *